US005297468A

United States Patent [19]

Dreizin

[11] Patent Number: 5,297,468

[45] Date of Patent: Mar. 29, 1994

[54] RAILGUN WITH ADVANCED RAIL AND BARREL DESIGN

[75] Inventor: Yuri A. Dreizin, Minneapolis, Minn.

[73] Assignee: Dyuar Incorporated, Minneapolis, Minn.

[21] Appl. No.: 874,781

[22] Filed: Apr. 27, 1992

[51] Int. Cl.[5] ..... F41B 6/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 1,422,427 | 7/1922 | Fauchon-Villeplee | 89/8 |
| 1,679,518 | 8/1928 | Fowle | 428/686 |
| 3,126,789 | 3/1964 | Meyer | 89/8 |
| 3,878,409 | 4/1975 | Gill et al. | 310/11 |
| 3,918,557 | 11/1975 | Ross, Sr. | 191/59.1 |
| 4,061,627 | 12/1977 | Conrow et al. | 534/689 |
| 4,200,831 | 4/1980 | Weldon et al. | 310/266 |
| 4,369,691 | 1/1983 | Baehr, Jr. et al. | 89/8 |
| 4,423,662 | 1/1984 | McAllister | 89/8 |
| 4,433,607 | 2/1984 | Kemeny | 89/8 |
| 4,457,205 | 7/1984 | Ross | 89/8 |
| 4,459,504 | 7/1984 | Weldon et al. | 310/243 |
| 4,467,696 | 8/1984 | McNab et al. | 89/8 |
| 4,485,720 | 12/1984 | Kemeny | 89/8 |
| 4,608,908 | 9/1986 | Carlson et al. | 89/8 |
| 4,625,618 | 12/1986 | Howanick | 89/8 |
| 4,694,729 | 9/1987 | Hall | 89/8 |
| 4,753,153 | 6/1988 | Jasper, Jr. | 89/8 |
| 4,831,913 | 5/1989 | Jasper, Jr. | 89/8 |
| 4,870,888 | 10/1989 | Weldon et al. | 89/8 |
| 4,884,489 | 12/1989 | Zowarka et al. | 89/8 |
| 4,913,030 | 4/1990 | Reynolds | 89/8 |
| 4,924,750 | 5/1990 | Neugebauer | 89/8 |
| 4,944,212 | 7/1990 | Hilal | 89/8 |
| 4,945,810 | 8/1990 | Parker | 89/8 |
| 4,953,441 | 9/1990 | Weldon et al. | 89/8 |
| 5,076,136 | 12/1991 | Aivaliotis et al. | 89/8 |
| 5,078,042 | 1/1992 | Jensen | 89/8 |
| 5,138,929 | 8/1992 | Weldon et al. | 89/8 |

OTHER PUBLICATIONS

Bedford, A. J., "Rail Damage and Armature Parameters for Different Railgun Rail Materials", IEEE Transactions on Magnetics, vol. MAG-20, No. 2, Mar. 1984, pp. 352-355.

Marshall, Richard A., "The Use of Nested Chevron Rails in a Distributed Energy Store Railgun", IEEE Transactions on Magnetics, vol. MAG-20, No. 2, Mar. 1984, pp. 389-390.

J. Barber, A. Chillita, B. Maas, L. Thurmond, *Contact Transistion in Metal Armatures*, IEEE Trans. Mag. vol. 27, No. 1, pp. 228-232 (Jan. 1991).

D. P. Bauer, J. P. Barber and H. F. Swift, *Application of Electromagnetic Accelerators to Space Propulsion*, IEEE Trans. Mag., vol. Mag-18, No. 1, pp. 170-175 (Jan. 1982).

A. L. Brooks, R. S. Hawke, J. K. Scudder and C. D. Wozynski, *Design and Fabrication of Large and Small Bore Railguns*, IEEE Trans. Mag., vol. Mag-18, No. 1, pp. 68-81 (Jan. 1982).

R. Burton et al., *Peformance of a Self-Augmented Railgun*, J. Appl. Phys., vol. 10, No. 7, pp. 80-84 (Jan. 1991).

M. Cowan, *Pulsed Power for Electromagnetic Launching*, IEEE Trans. Mag., vol. Mag-18, No. 1, pp. 145-150 (Jan. 1982).

(List continued on next page.)

*Primary Examiner*—Stephen C. Bentley
*Attorney, Agent, or Firm*—Kinney & Lange

[57] ABSTRACT

A railgun apparatus for accelerating a projectile having a conductive region. The railgun comprises a power supply for providing a current impulse and at least two elongate generally parallel rails. The rails include a first layer comprising a highly conductive material and a second layer comprising a highly resistive layer. The second layer has a resistivity that varies along the length of the rails and is so sized and arranged as to contact the conductive region of the projectile. The power supply is switchably connected to the first layer of the rails. When the current impulse is applied to the rails with the projectile therebetween, the current impulse is spread over the conductive region of the projectile to reduce the velocity skin effect.

14 Claims, 5 Drawing Sheets

OTHER PUBLICATIONS

F. J. Deadrick, R. S. Hawke and J. D. Scudder, *Magrac—A Railgun Simulation Program,* IEEE Trans. Mag., vol. Mag-18, No. 1, pp. 94-104 (Jan. 1982).

D. W. Deis and I. R. McNab, *A Laboratory Demonstration Electromagnetic Launcher,* IEEE Trans. Mag., vol. Mag-18, No. 1, pp. 16-22 (Jan. 1982).

D. W. Deis and D. P. Ross, *Experimental Launcher Facility-ELF-I: Design and Operation,* IEEE Trans. Mag., vol. Mag-18, No. 1, pp. 23-28 (Jan. 1982).

H. D. Fair, Jr., *Electromagnetic Propulsion: A New Initiative,* IEEE Trans. Mag., vol. Mag-18, No. 1, pp. 4-6 (Jan. 1982).

C. M. Fowler, D. R. Peterson, R. S. Caird, D. J. Erickson, B. L. Freeman and J. C. King, *Explosive Flux Compression Generators for Rail Gun Power Sources,* IEEE Trans. Mag., vol. Mag-18, No. 1, pp. 64-67 (Jan. 1982).

R. Hawke, *Railgun Accelerators for Launching 0.1-g Payloads at Velocities Greater than 150 km/s,* Lawrence Livermore Lab. Rep. No. CONF-790741-1 (Jun. 15, 1979), DOE Impact Fusion Workship GRAI8004, NSA0400.

T. James, *Performance Criteria for EM Launchers with Solid or Transistion Armatures and Laminated Rails,* IEEE Trans. Mag., vol. 27, No. 1, pp. 482-489 (Jan. 1991).

H. Kolm, *Electromagnetic Accelerator Concepts,* DOE Impact Fusion Workshop, Los Alamos, N.M. (Jul. 10-12, 1979), Available from NTIS, Springfield, Va. pp. 206-217 (1979).

R. S. Hawke, A. L. Brooks, F. J. Deadrick, J. K. Scudder, C. M. Fowler, R. S. Caird and D. R. Peterson, *Results of Railgun Experiments Powered by Magnetic Flux Compression Generators,* IEEE Trans. Mag., vol. Mag-18, No. 1, pp. 82-93 (Jan. 1982).

R. N. Kostoff, A. T. Peaslee, Jr. and F. L. Ribe, *Possible Application of Electromagnetic Guns to Impact Fusion,* IEEE Trans. Mag., vol. Mag-18, No. 1, pp. 194-196 (Jan. 1982).

C. G. Long, *Fundamental Limits to the Velocity of Solid Armatures,* Doctoral Dissertation, University of Texas at Austin, pp. 15-22 (Aug. 1987).

G. C. Long and W. F. Weldon, *Limits to the Velocity of Solid Armatures in Railguns,* IEEE Trans. Mag., vol. 25, No. 1, pp. 347-352 (Jan. 1989).

J. Marshall, *Kaliski's Explosive Driven Fusion Experiments,* DOE Impact Fusion Workshop, Rep. No. CONF-790741-6, NTIS LA-UR-79-1840, pp. 441-449, Los Alamos, N.M. (Jul. 10, 1979).

R. Marshall, *Railgun Overview,* DOE Impact Fusion Workshop, Los Alamos, N.M. (Jul. 10-12, 1979) Available from NTIS, Springfield, Va. pp. 128-145.

P. Mongeau and F. Williams, *Arc-commutated Launcher,* IEEE Trans. Mag., vol. Mag-18, No. 1, pp. 42-45 (Jan. 1982).

J. Parker, *Muzzle Shunt Augmentation of Conventional Railguns,* IEEE Trans. Mag., vol. 27, No. 1, pp. 80-84 (Jan. 1991).

P. B. Parks, *Current Melt-Wave Model for Transitioning Solid Armature,* J. Appl. Physics, vol. 67, No. 7, pp. 3511-3516 (Apr. 1990).

D. Peterson et al., *Rail Gun Powered by an Integral Explosive Generator,* Los Alamos Nat. Lab. Rep. LA-8000-C (May 1979).

I. M. Vitkovitsky, R. D. Ford, D. Jenkins and W. H. Lupton, *Homopolar Current Source for Mass Accelerators,* IEEE Trans. Mag., vol. Mag-18, No. 1, pp. 157-159 (Jan. 1982).

F. J. Young and W. F. Hughes, *Rail and Armature Current Distributions in Electromagnetic Launchers,* IEEE Trans. Mag., vol. Mag-18, No. 1, pp. 33-41 (Jan. 1982).

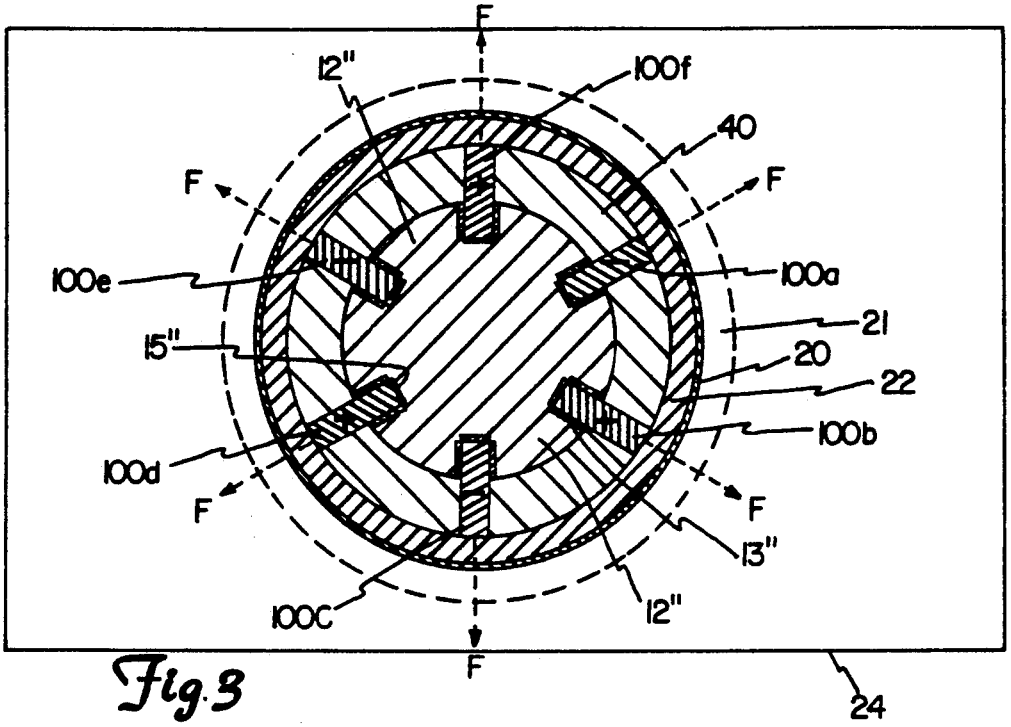
Fig. 3
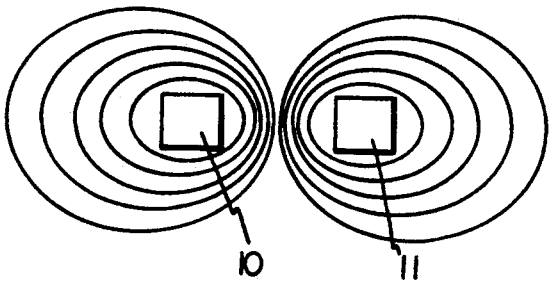
Fig. 4a
Fig. 4b
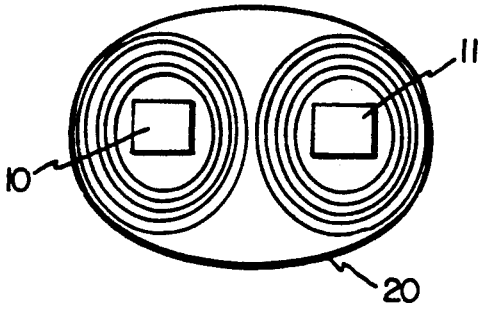

RAILGUN WITH ADVANCED RAIL AND BARREL DESIGN

FIELD OF THE INVENTION

The present invention relates generally to an electromagnetic device, and more particularly to an electromagnetic launcher which accelerates a mass to a high exit velocity.

BACKGROUND OF THE INVENTION

Electromagnetic railguns (EMR) are generally known in the prior art. A typical railgun includes at least one pair of oppositely spaced generally parallel electrically conducting rails. The breech ends of the rails are connected to a source of strong pulsed current. A projectile is placed between the rails. To accelerate the projectile, a conductive solid armature or a plasma armature is used. When the current pulse is applied to the rails, the armature completes the current path between the rails, and, as those skilled in the art will appreciate the armature and projectile are accelerated by the force jxB.

In solid conductive armature railguns, one of the factors limiting the achievable velocity is the Joule heating of the armature. However, through use of a high conductive metallic armature (copper, for example) a very high velocity might be achieved before it begins to melt if the current in the armature were uniform.

In practice, however, a partial melting and vaporization of the metal armature (and subsequent transition to the plasma armature regime of acceleration) usually occurs after the solid armature has been accelerated to a certain critical velocity, typically on the order of 1 km/s. By using a plasma armature regime, the projectile can be further accelerated. However, numerous studies have shown that there exists a certain critical velocity, typically 6–7 km/s, for the plasma armature method of acceleration. Near this critical velocity most of the driving force is used to involve into motion new portions of material ablating from the rails and isolator walls of the bore, thus no further increase of the projectile velocity occurs. Thus, it is important to understand causes of the failure of the solid armature regime and to find suitable means to prevent it.

Both theoretically and experimentally it has been shown that an intense melting and vaporization of the solid armature material occurs due to high concentration of current in a small region near the rear end of the contact zone between the solid armature and each of the rails. This phenomenon—the "velocity skin effect"—has much in common with the conventional "skin effect" for pulsed current, and is caused by the slow diffusion of the magnetic field in the high conductive rails which are ordinarily used in the railguns.

Another cause of intense ablation and erosion of the armature and rails may be connected with a loss of electromechanical contact between the solid armature and rails due to gaps. The gaps may appear, in particular, due to displacements of the rails caused by strong magnetic repulsion of opposite currents in the rails. The current then passes through the gaps (between the armature and rails) in the regime of gas discharge. The energy dissipated in the gas discharge overheats the surfaces of the rail and armature due to heat conduction and intensive radiation. As a result, a plasma armature may appear.

On the other hand, excessive tightening of the electromechanical contact to ensure the contact between rails and solid armature may result in increased friction losses, overheating of the rail and armature contacting surfaces, and gouging of the armature and rails at high relative velocity. Further, increasing the stiffness of the rails typically involves making the railgun barrel more massive and complex.

Thus, it will be appreciated by those skilled in the art that to develop an effective armature/rail combination and a barrel design, several various requirements and design considerations should be simultaneously met and taken into account. First, it is important to virtually avoid gaps between the rails and the armature appearing due to magnetic forces. Second, at the same time the contact between the armature and rails should be kept moderately tight. Third, it is important to avoid significant current concentration due to the velocity skin effect.

Several approaches have been presented previously which were partial solutions to these problems. In particular, it has been recommended to diminish rail displacements, and thus to reduce gaps, by increasing the stiffness of the railgun barrel. Also, several approaches have been aimed at improving the electromechanical contact and to diminish current concentration by providing:

(a) flexible trailing ends of the armature;
(b) wire contactors at the side or at the trailing edge of the armature;
(c) a chevron shaped armature, consisting of intermittent laminas of highly conductive and highly resistive materials; and
(d) compounded rails including high resistive layers on the contact side of the rail, with the thickness increasing from the breech end to the muzzle end of a barrel.

However, none of the prior art has accomplished each of the desired goals. Therefore, there arises a need for a railgun which is capable of reducing local current densities to reduce arcing and reducing the need for massively solid/rigid rails. The present invention directly address and overcomes the shortcomings of the prior art.

SUMMARY OF THE INVENTION

The present invention provides an improved railgun design to accelerate a mass to a high exit velocity. The invention improves the electrical contact between the armature and rails by providing for the contact to be arranged and configured parallel to the forces acting on the rail, wherein movement or deflection of the rail does not appreciably diminish the contact or create a gap. Further, the invention provides a countering force to deflection of the rails by providing for a highly conductive screen proximate the exterior, or side opposite the breech, of the rails whereby the magnetic field acts to counter the repelling forces from the currents in the opposing rails. As a direct result of the foregoing items, the mass of the railgun barrel may be reduced since the requirement of the rails being absolutely rigid is diminished.

Still further, the invention improves localized current density in the armature by utilizing a second highly resistive layer, thereby allowing the magnetic field (and therefore the current in the rails) to penetrate the second layer more rapidly which reduces the velocity skin effect. Additionally, a third highly conductive layer may be utilized between the second highly resistive layer and the armature to provide for improved electrical contact.

In a preferred embodiment of a device constructed according to the principle of the present invention, the railgun includes two or more conductive rails switchably attached to a pulsed current source. The rails have a first conductive layer and cooperatively mate with a conductive armature. Preferably the armature has conductive members which are received within channels formed in the rails (i.e., the rails are "C" shaped). Optionally, the armature itself may include channels, in which event the rails are disposed within the channels.

The rails also include second highly resistive layers at those contact areas with the armature which are parallel to the forces acting on the rails when current flows in the rails. Those skilled in the art will appreciate that these contact areas are the side walls of the channels. A nonconductive/insulating layer may also be provided at the base or bottom of the channel to avoid establishing electrical connection in this region since if the rails move a gap will form. The second highly resistive layer is preferably of a uniform or decreasing width from the breech to the muzzle end of the rails. A third very thin and highly conductive layer which aids in the electrical contact between the conductive armature and the second layer may also be used. The third layer is preferably a series of raised and lowered elevations of a conductive material (e.g., an undulating strip of 10 micron copper or a series of curved strips) which maintain electrical connection between the armature and rails despite localized deformations in the two at the high forces of the railgun, thereby further enabling a more uniform current density.

Further, the preferred railgun constructed according to the present invention includes a thin screen of highly conductive material (such as copper or aluminum) located about the periphery of the rails. This screen means has the effect of not allowing the magnetic field to penetrate through the screening means as the armature is propelled past a given point. Therefore, the flux lines of the magnetic field are compressed against the back-/exterior of the rail providing an opposite and countervailing force to the magnetic forces tending to force the rails apart from one another.

One particular application for a preferred embodiment of the present invention is its use in accelerating an armature carrying a projectile. Other uses of the invention described herein will be apparent to those skilled in the art.

Therefore, according to one aspect of the invention, there is provided a railgun apparatus comprising: a) a power supply for providing a current impulse; b) a projectile having a conductive region; and c) at least two elongate generally parallel rails, said rails having two layers, said first layer being comprised of a highly conductive material and said second layer being comprised of a highly resistive layer which is varied along the length of said rails, said power supply being switchably connected to said first layer of said rails, and said conductive region of said projectile contacting said second layer of said rails, wherein when said current impulse is applied to said rails the current is spread over the conductive region of said projectile and velocity skin effect is reduced.

According to another aspect of the invention, there is provided a railgun apparatus comprising: a) a power supply for providing a current impulse; b) a plurality of elongate generally parallel rails, said rails defining a bore therebetween, and said rails being operably connected to said power supply to provide a current flow path; and c) a conductive armature, said armature being arranged and configured to slidably engage said rails, wherein the current flow path through said armature is through at least one connection path which is parallel to the forces acting on said rails when power is supplied, whereby gaps between said armature and said rails are minimized.

These and other advantages and features which characterize the present invention are pointed out with particularity in the claims annexed hereto and forming further part hereto. However, for a better understanding of the invention, its advantages and objects attained by its use, reference should be made to the Drawing which forms a further part hereof, and to the accompanying descriptive matter, in which there is illustrated and described a preferred embodiment of the present invention.

BRIEF DESCRIPTION OF THE DRAWING

In the Drawings, like reference numerals and letters indicate corresponding elements throughout the several views:

FIG. 3 is a second alternative embodiment of the cross section of FIG. 2, wherein several additional rails are used;

FIG. 4*a* is a schematic representation of magnetic lines around rails 10 and 11 when current is flowing the rails 10 and 11 without a screen;

FIG. 4*b* is a schematic representation of the compression of the magnetic lines of flux prior to the magnetic field penetrating the highly conductive screen 20 placed around rails 10 and 11;

DETAILED DESCRIPTION

As mentioned above, the principles of this invention apply to a railgun designed for electromagnetically accelerating a mass to a high exit velocity. The railgun of the present invention provides a rail geometry, layered rails, and magnetic screening to provide for increased electrical contact, reduced velocity skin effect, and minimized barrel/rail stiffness requirements.

Figure 1:
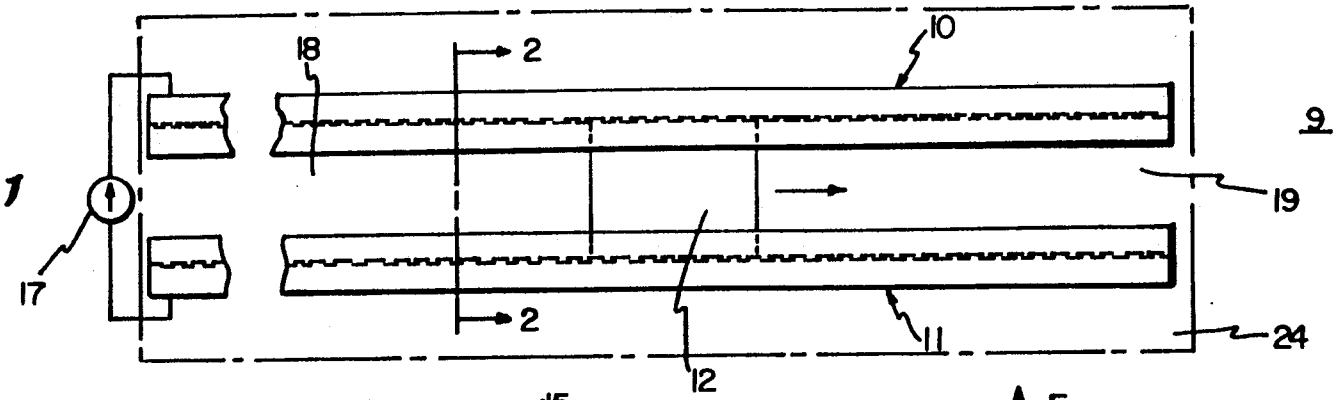
FIG. 1 is schematic diagram of a railgun constructed according to the principles of the present invention.

Referring first to FIG. 1, there is illustrated diagrammatically a railgun 9 in accordance with the present invention. While those skilled in the art will appreciate and understand the general theory of operation of railgun 9, a brief description will follow. The railgun 9 includes power supply 17, armature means 12, and rails 10 and 11. Power supply 17 is switchably connected to the rails and may be a homopolar generator, although those skilled in the art will appreciate that other types of energy devices may be used. For example, a capacitor-based energy system may be cooperatively connected to the rails. A specific type of homopolar generator is described in U.S. Pat. No. 4,459,504, which is incorporated herein by reference. Because the rail gun 9 of the present invention is of greater interest at hypervelocity operations, the power supply 17 should be generally capable of delivering at least 500 kiloamps.

The armature means 12 is preferably a solid armature as illustrated in the Drawings. A projectile (not shown) may be mounted on the armature 12 and may be appropriately shaped depending on the application of the rail gun 9 (i.e., aerodynamic considerations, penetrating ability, length/diameter ratio, etc.). The armature 12 itself may be slightly tapered toward the muzzle end 19 of the railgun barrel 24 shown in FIG. 8*a*.

The railgun 9 itself broadly includes a pair of spaced, oppositely disposed elongated rails 10 and 11 defining a, bore therebetween. The rails 10 and 11 include a breech end 18, a muzzle end 19, with the power supply 17 switchably connected to the rails 10 and 11 at the breech end 18. The armature 12 is received in the bore for slidable movement from the breech end 18 to the muzzle end 19 in the direction of the arrow shown in FIG. 1.

Figure 2B:
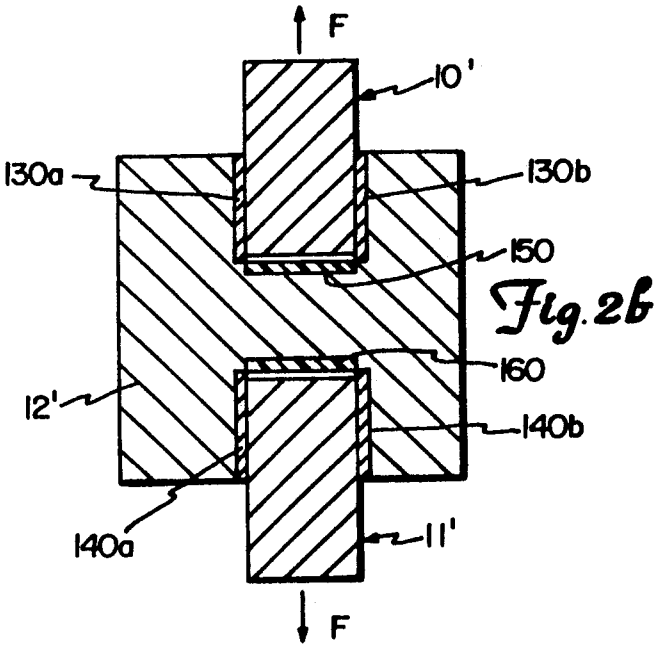
FIG. 2*b* is an alternative embodiment of the cross section of FIG. 2*a;*
Figure 2A:
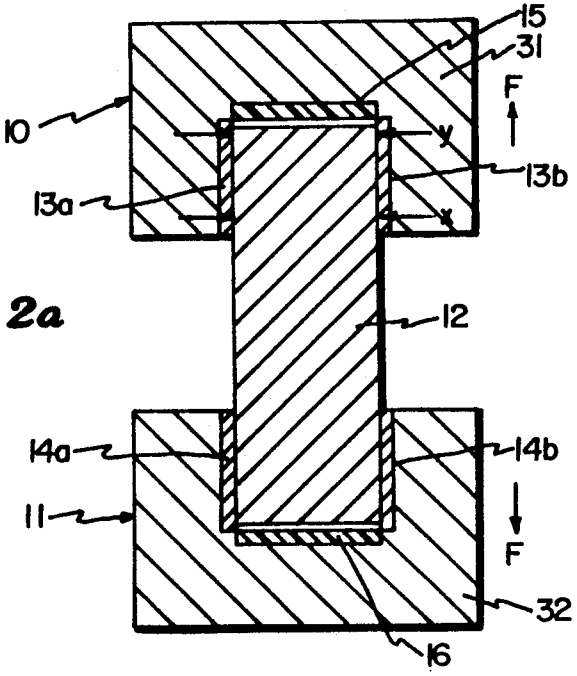
FIG. 2*a* is a cross section of the rails 10 and 11, and the armature 12 of the railgun 9 of FIG. 1 taken through 2—2.

Referring next to FIGS. 2*a*, 2*b*, and 3, the geometry of the armature 12 and the rails 10 and 11 will next be described.

In order to avoid or significantly diminish gaps appearing between the armature 12 and rails 10, 11 in the zone of electrical contact (i.e., the electrical contact path), it is expedient to modify the geometry of the contact path from previous railguns in such a way that the contacting areas at the surfaces of the rail 10, 11 and the armature 12 are planar and are generally parallel to the direction of the prevailing displacement of the rails 10, 11 (best seen in FIGS. 2*a*, 2*b* and 3 illustrated by the force vectors F, the corresponding components in FIG. 2*b* can be labeled with primes and with double primes in FIG. 3 except the rails which are labeled 100*a*–100*f* in FIG. 3) due to magnetic force. This can be achieved, for example, by means of channels in the rails or channels in the armature, as shown in FIG. 2*a* and 2*b* respectively for a conventional two-rail railgun, and in FIG. 3 for a multiple rail railgun.

It is clear that due to such geometry of the contact the permissible displacements of the rails 10, 11 may increase, and thus materials with a high specific yield strength but low stiffness, like carbon plastics, may be used in the barrel 24 design (i.e. for the means for securing the rails 40 in proper position to one another shown in FIG. 3). Using a slight "unparallelness" between the contact areas and the direction of the prevailing displacement—for example, using a slightly "dovetail" geometry of the channel walls—it is possible to influence or regulate the tightness of the electrical contact. This may be useful, in particular, to compensate for transverse deformation of the armature 12 appearing during acceleration. For example, as best seen in FIG. 2*a*, the width at point x of the channel may be slightly narrower than at point y. Similarly, the armature 12 may be slightly narrower at point x than at point y.

Therefore, each rail 10, 11 includes channels into which the armature 12 is slidably engaged. The channels are formed of side walls and a bottom. Preferably, the rail 10 and 11 are constructed of a high conductive material, such as copper. This conductive material is considered the first layers 31 and 32. Those skilled in the art will recognize that in the preferred embodiment rails 10 and 11 (10' and 11') are mirror images of one another and so the discussion pertaining to rail 10 also pertains to rail 11. Second layers 13*a*, 13*b* are placed on the channel's side walls at the area where electrical contact with the armature 12 is desired. In essence, the second layers are embedded or are bonded to the first layers 31 of rail 10 and 32 of rail 11. The functionality of the second layers 13*a*, 13*b* is discussed further below. An insulating layer 15 (constructed of a dielectric or ceramic) is used in those areas of the channel where electrical contact is not desired—here in the preferred embodiment at the bottom of the channels. The insulating layer 15 is used since electrical contact would cause arcing if the rails moved apart. In the latter case, the same problems which occurred in the prior art would then occur in this bottom channel region. Accordingly, the insulating layer 15 is placed to avoid electrical contact.

A second method of reducing gaps, which can be used independently or jointly with the above geometry of the contact is based on reducing the displacements of the rails 10, 11 due to the magnetic forces. More specifically, high conductive screening means 20 (best seen in FIGS. 3 and 4*b*) placed so as to surround the rails 10, 11 can be used. It is well known that high conductivity materials serve as a screen for pulsed magnetic fields and so may influence the field distribution. This screening effect can be used to compensate magnetic interactions of currents in the rails, if the distance between the rails and the conductive screen is chosen properly. FIGS. 4*a* and 4*b* illustrate unscreened and screened magnetic flux lines. Those skilled in the art will appreciate that the screening, although "instantaneous" as will next be described, is useful in view of the duration of time of the firing of the armature 12.

The degree due to such compensation of the screening is determined by the ratio of the depth of skin effect of the screen 20 and the distance between rails 10, 11. During the time typically required for the solid armature 12 to pass a given point on the rails 10, 11 the depth of skin effect is less than 1 mm (i.e., the armature is typically moving at several km/s), and thus displacements of the rails 10, 11, in the contact zone can be reduced by a factor of 10–100 for railguns, with a bore size in the centimeter range.

A conductive screen 20 for reducing rail 10, 11 displacement is shown in FIG. 4*b* for a two-rail railgun (oval shape) and in FIG. 3 for a multiple rail railgun (circular shape). It will be appreciated that it is possible to shape the cross-section of screen 20 in such a way that its main deformation will be stretching, and by providing a strong winding about the screen 20 this concern is eliminated. In the case of the multiple rail railgun the screen 20 may be a tube of a circular cross-section to form the barrel or it may be within the barrel with the barrel forming a tubular restraining member 21 proximate the exterior of the screen 20 to form the strengthening winding. A dielectrical material 22 is used as a filler material between the rails 10, 11 and the screen 20 to help fix the geometry.

Figure 5:
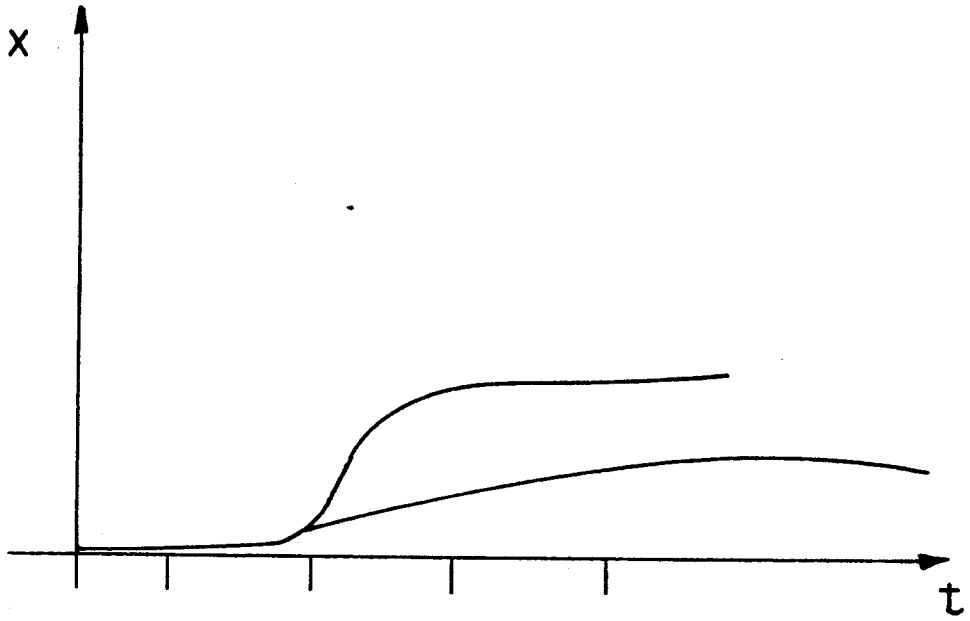
FIG. 5 is a graph representing the reduced wavelength of deformation of the rails 10 and 11 when screen 20 is used.

After a given period of time, the skin effect depth (magnetic field penetration) in the rails 10, 11 and in the screen 20 will increase and the net force acting on the rails 10, 11 will also increase. However, an added benefit of such screening is that due to the screening effect, the bending deformations (x) of the rails 10, 11 have longer wavelengths over time (t). This is illustrated in FIG. 5. Thus, their propagation along the rails 10, 11 is much slower, and they can not overtake the armature 12. This is a favorable factor, as the propagation of such elastic deformations ahead of the armature 12 and possible resonant effects in their interaction with the armature 12 are highly undesirable. Additionally, such deformations may cause gaps.

In addition to the improved geometrical contact, the design considerations aimed to diminish or eliminate the effect of concentration of current in the contact zone due to velocity skin effect are very important. U.S. Pat. No. 4,953,441 issued to Weldon et al. disclosed a compound rail including a conductive layer and a layer of high resistivity material at the contact side of the rail to counteract the current concentration. Weldon et al. disclosed and taught that the optimal design configuration of such rails corresponds to a highly resistive layer of variable thickness. More specifically, Weldon et al. taught that the thickness should increase from the breech end to the muzzle end. However, this is in contradiction to the results of consistent theory of electrodynamic and thermal processes in the contact area between the armature and a compound rail comprising a highly resistive layer.

The present invention differs from Weldon et al. and both the geometry and qualitative results differ. A more detailed presentation of the theoretical analysis as found in Y. Dreizin, *Solid Armature Performance With Resistive Rails,* IEEE Trans. Mag., Vol. 29, No. 1, pp. 798–803 (Jan. 1993), which is hereby incorporated by reference.

Continuing now with the preferred embodiment, the result of the present invention's theoretical analysis shows that it is possible to broaden the zone of current flow between the rails 10, 11 and the armature 12 up to the entire length of the geometrical contact between the two. The resistivity of the resistive layer ($\rho r$) is related to the desired depth of the velocity skin effect which determines the width of current concentration zone ($\delta v$) by the formula $$\delta_r = \mu_0 V \delta_v$$

Where:

$\mu_0$ is the permeability of free space; and

V is the velocity of armature 12

In view of this equation, for example, to have the velocity skin effect width be on the order of 2 cm at a velocity of 3 km/s, then the resistivity of the layer should be 3000 times greater than the resistivity of copper. Further, as the velocity increases from the breech end 18 to the muzzle end 19, the resistivity should increase proportionally to the expected velocity.

Figure 7:
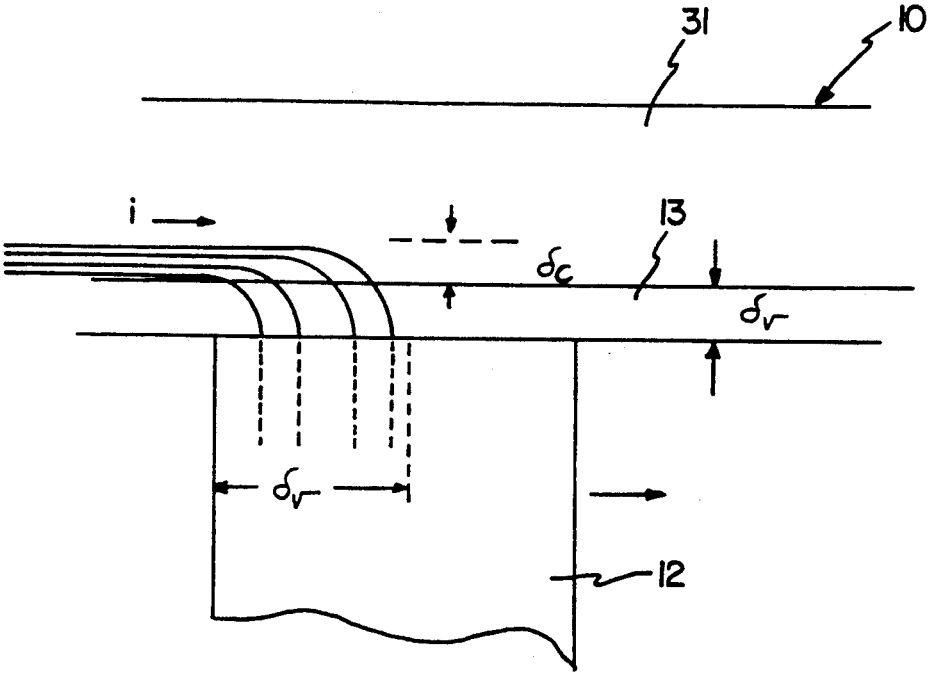
FIG. 7 is a schematic representation illustrating several definitions including the zone of increased current density.

The thickness of the resistive second layer 13, 14 should exceed several times the skin depth ($\delta_c$) (best seen in FIG. 7) of the conductive layer 30 of the rail 10, which is determined by the formula:

$$\delta_c = \frac{\sqrt{\rho_c \rho_r}}{\mu_0 V}$$

Where:

$\rho_c$ is the resistivity of the conductive layer;

$\rho_r$ is the resistivity of the resistive layer;

$\mu_0$ is the permeability of free space; and

V is the velocity of the armature.

Typically, the thickness of the resistive layer 13, 14 should be on the order of several millimeters, and its minimal value, given by the latter formula, decreases from the breech end 18 to the muzzle end 19 of the barrel 24.

Figure 6:
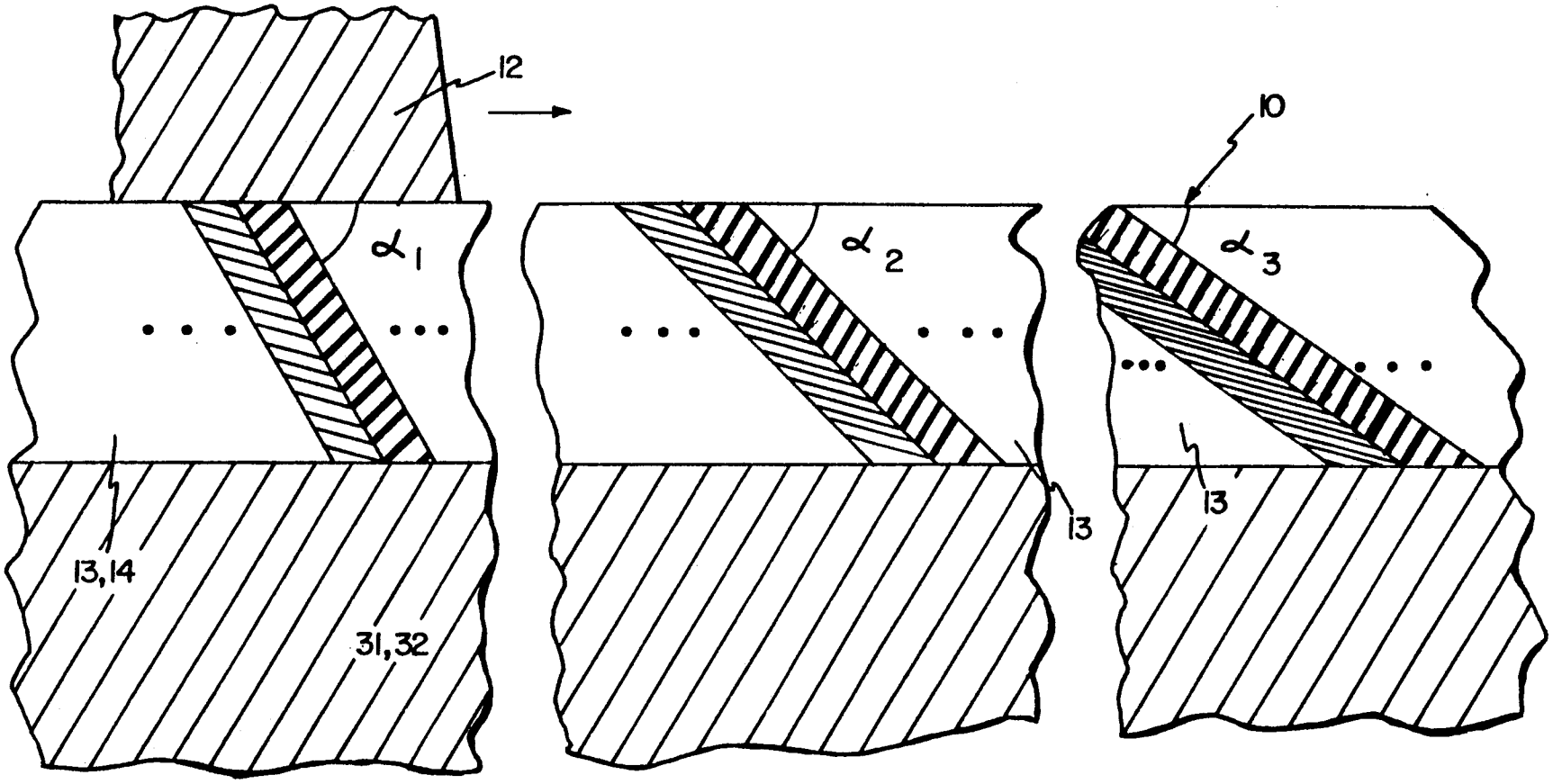
FIG. 6 is a preferred embodiment second layer 13, 14 wherein the resistivity is profiled.

In a preferred embodiment, the resistive layer 13 and 14 (which allows for a convenient method of resistivity variation along the length of the railgun barrel 24) is a layer composed of intermittent (i.e. alternating) thin laminas of resistive metal (for example, with the resistivity ($\rho_m$) 100 times exceeding copper resistivity), and dielectric material. Such a chevron-type resistive layer should have laminas laid out at a small angle ($\alpha$) with respect to the contact surface path of the rail. This is shown in FIG. 6 (where $\alpha_1 > \alpha_2 > \alpha_3$). Therefore, the effective transverse resistivity of the layer ($\rho_{eff}$), which determines the velocity skin effect, is given, approximately, by the formula $$\rho_{eff} = \rho_m / \sin^2 \alpha$$

Thus it is possible to change $\rho_{eff}$ by changing the angle between the rail and direction of laminas.

The heating of the resistive layer in the case of the geometrically ideal contact is of the order of the energy density of the magnetic field. This is similar to the ordinary skin effect. Thus resistive layers don't put new restrictions to the strength of magnetic field and so don't affect the efficiency of the railgun 9. However, if the geometrical contact is tight only in a small fraction of the contact zone, and in the rest of this zone a geometrical gap hinders the current flow, then the current concentration effect due to geometrical gaps may strongly overheat and destroy the resistive rail. Thus, the use of the resistive layers 13, 14 may benefit from a third layer to improve the geometrical quality of the contact.

To improve the quality of geometrical contact and, simultaneously, to diminish significantly the friction in the sliding contact and the danger of gouging at the contact a special high conductive coating third layer between the above described resistive layer and the contact surface of armature may be used. Therefore, three layers are used in the preferred embodiment. The highly conductive core of the rail 10 serves to carry current from the current source 17 to the armature 12. A highly resistive second layer 13 serves to prevent current concentration at the trailing contact area and to protect the armature 12 from overheating. And the third layer 25 or 26 (shown in FIG. 8*a*) which covers the high resistive second layer 13 and which immediately contacts with the armature 12, is used to diminish friction, to ensure geometrical contact at the entire contact zone and thereby to protect the resistive layer 13, 14 from overheating.

Figure 8A:
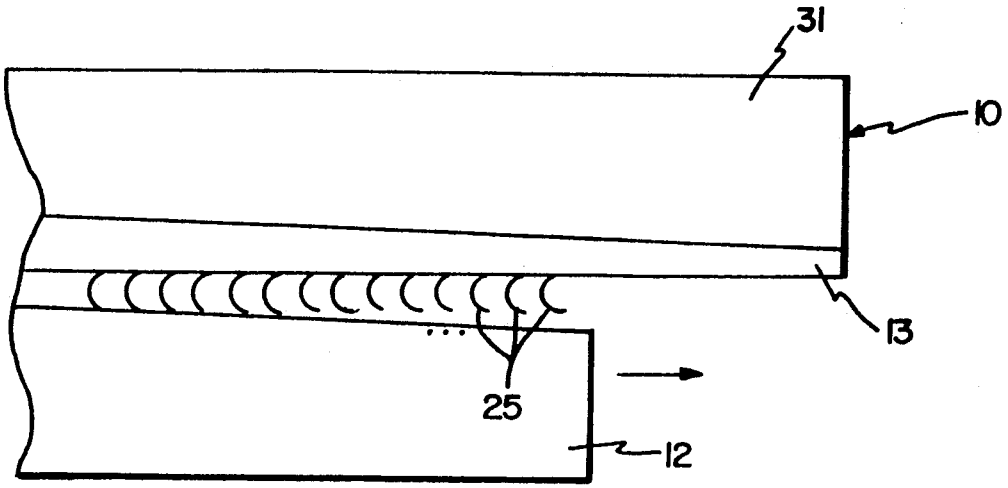
FIG. 8*a* is a schematic representation of the third layer 25 comprised of metallic petals and a tapering second layer 13.
Figure 8B:
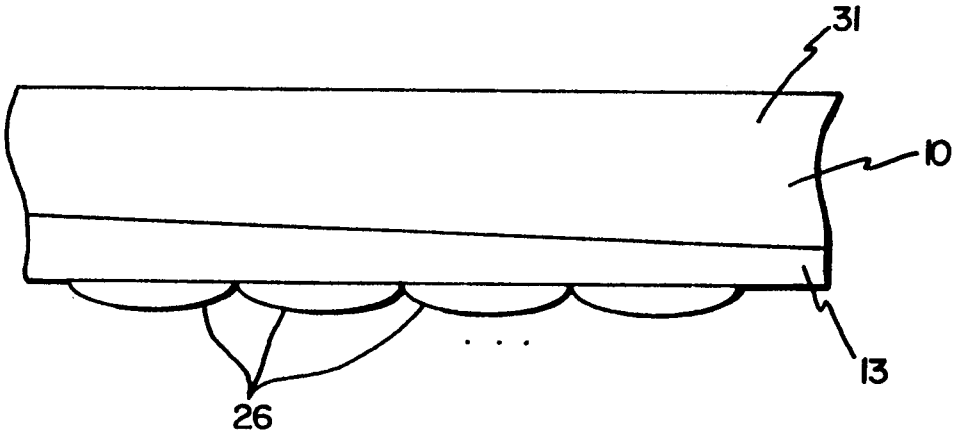
FIG. 8*b* is a schematic representation of a second embodiment third layer 26 comprised of an undulating metallic strip.

This third layer 25, 26 is comprised of thin foil of high conductive material, for example copper. The foil creates a sort of rarified foil brush, contacting the armature 12. The armature 12 is typically shaped in such a manner, that the above foil brush is gradually pressed by the side surface of the armature 12. Thus, the pressure acting on the side surface of the armature 12 from the foil 25, 26 is proportional to the foil acceleration (which is determined by the shape of the gap between the armature 12 and the rail 10 and by velocity of the armature 12), and to the mass of the foil. For a thin and rare foil brush, the pressure, and consequently the friction, are at least two orders of magnitude less that at the ordinary contact between two solid material. The foil brush and its interaction with the moving armature are shown in FIG. 8*a* and 8*b*.

It should be noted that the possibility to use a thin highly conductive foil at the contact surface of the rail is inseparably linked with the reduction of the velocity skin effect by the highly resistive layer 13, 14, at least in a strong enough magnetic field. The attempt to use the foil brush with the ordinary highly conductive rail will unavoidably fail due to the overheating of the foil conductor.

The thickness of the foil $d_f$ and the density $N_f$ (the number of foil petals in one centimeter) of the may be found from:

$$n_f \cdot d_f \sim \sqrt{\rho_f/\rho_r}$$

where $\rho_r$ is the effective resistivity of resistive layer and $\rho_f$ is the resistivity of the foil material. For the above example, with effective resistivity of this layer 3000 times greater than that of copper, this yields that average density of the foil brush is 50 times less then density of copper.

CONCLUSION

The above formulated organization of contact between the rail and the armature may require use of a separate rail, or separate parts of the surface of the same rails, to serve as guiding rails. This separating of functions (in an ordinary railgun the surface of the rail simultaneously performs both functions) may be considered as an advantage, as both types of surfaces may be optimized independently to perform a particular function.

The velocity skin effect and limits it sets to projectile velocities in solid armature railguns have been considered previously. However, the most promising type of the rail design seems to have been missed. This analysis substantiates the use of highly resistive layers on the contact surfaces of rails. Such layers virtually eliminate the velocity skin effect. The electrodynamical and thermal problems for several rails and armature combinations are solved. The results show that with highly resistive rails in combination with conductive armatures it is possible to reach velocities far exceeding 10 km/s in the conventional electromechanical regime of acceleration without overheating armatures and rails.

What is claimed is:

1. A railgun apparatus for accelerating a projectile having a conductive region, comprising:

a) a power supply for providing a current impulse;

b) at least two elongate generally parallel rails which define a bore therebetween with a breech end and a muzzle end, wherein an accelerating projectile has a breech velocity at the breech end and a muzzle velocity at the muzzle end which differ, with more than half of the difference between the breech and muzzle velocities occurring in a main acceleration region of the bore; and c) wherein said rails have two layers, said first layer being comprised of a highly conductive material which is switchably connected to said power supply and said second layer being comprised of a highly resistive layer which has a resistivity that varies along the main acceleration region of said bore, and said second layers being so sized and arranged as to contact the conductive region of the projectile so that when said current impulse is applied to said rails to accelerate the projectile, the current is spread over the conductive region of the accelerating projectile, and velocity skin effect is reduced.

2. The railgun of claim 1, wherein said second layers each form a mean plane and wherein said rails include a third conductive layer cooperatively attached to said second layers, said third layers comprised of a thin conductive material that deforms as the conductive region of said projectile makes contact with the third layers.

3. The railgun of claim 1, wherein said first layer is copper and wherein said second layer is approximately 3,000 times more resistive than said first layer.

4. The railgun of claim 1, wherein said rails and said projectile are arranged and configured to establish a contact region parallel to the magnetic forces applied to said rails during the current impulse, whereby gaps between said rails and said conductive region of said projectile are minimized.

5. The railgun of claim 4, wherein each of said rails include channels formed longitudinally therein, said channels facing one another and each of said channels having two interior sides and an interior bottom, said second layers residing solely in said two interior sides.

6. The railgun of claim 4, wherein said projectile has channels formed therein corresponding to said rails, said channels having two interior sides and an interior bottom, said second layers residing solely in said two interior sides.

7. The railgun of claim 1, further comprising a conductive enclosure surrounding said rails which compresses against said rails the magnetic field that is generated when the current impulse is applied to said rails to counter-balance a repulsion force experienced by said rails.

8. The railgun of claim 8, wherein said enclosure is a tube having a cross-sectional that limits deformation of the tube caused by the magnetic field to stretching deformation.

9. The railgun of claim 7, wherein said enclosure has an internal and an external side, and further comprising a winding about said external side, wherein said enclosure is strengthened against breaking due to stretching deformation.

10. The railgun of claim 1, said bore has a longitudinal axis and wherein said second layer is comprised of alternating laminas of electrically conductive and dielectric material oriented at differing angles to the longitudinal axis, whereby said resistivity varies along the length of said rails.

11. A railgun for accelerating a conductive armature, comprising:

a power supply for providing a current impulse;

a bore having a breech end, a muzzle end and a main acceleration region, with the armature having a breech velocity at the breech end and a muzzle velocity at the muzzle end which differ, with more than half of the difference between the breech and muzzle velocities occurring in the main acceleration region of the bore; and a plurality of elongate, generally parallel rails connected to the power supply, each rail having a conductive layer and a resistive layer, the resistive layer forming the bore, each resistive layer having a resistance which increases along the main acceleration region to spread current along the armature, the bore being so disposed and arranged that the conductive armature is positioned within the bore and is in slidable contact with the resistive layer of each rail, with the slidable contact being separated along the bore from the conductive layers by a fixed gap along the main acceleration region of the bore.

12. The railgun of claim 11 wherein the resistive layers have resistivities that vary along the bore and have a generally constant thickness, as measured between the conductive layers and the slidably contact.

13. A railgun apparatus for accelerating a projectile having a conductive region, comprising:

a) a power supply for providing a current impulse;

b) at least two elongate generally parallel rails, said rails having two layers, said first layer being comprised of a highly conductive material and said second layer being comprised of a highly resistive layer which has a resistivity that varies along the length of said rails, said power supply being switchably connected to said first layer of said rails, and said second layers being so sized and arranged as to contact the conductive region of the projectile so that when said current impulse is applied to said rails to accelerate the projectile, the current is spread over the conductive region of the accelerating projectile, and velocity skin effect is reduced; and c) wherein the resistivity ($\rho_r$) of said second layer along the length of said rails varies in accordance with the following equation:

$$\rho_r \sim \mu_0 V \delta_v$$

where $\mu_0$ is the permeability of free space, V is the velocity of the projectile and $\delta_v$ is the width of a desired current concentration zone.

14. A railgun apparatus for accelerating a projectile having a conductive region, the railgun apparatus comprising:

a) a power supply for providing a current impulse;

b) at least two elongate generally parallel rails which define a bore therebetween with a breech end, a muzzle end and a length which is measured between the breech end and the muzzle end; and c) wherein said rails have two layers, being comprised of a highly conductive material which is switchably connected to said power supply and said second layer being comprised of a highly resistive layer which has a resistivity that varies along the bore over a distance that is at least half of the length of the bore, and said second layers being so sized and arranged as to contact the conductive region of the projectile so that when said current impulse is applied to said rails to accelerate the projectile, the current is spread over the conductive region of the accelerating projectile, and velocity skin effect is reduced.

* * * * *

UNITED STATES PATENT AND TRADEMARK OFFICE

CERTIFICATE OF CORRECTION

PATENT NO. : 5,297,468

DATED : March 29, 1994

INVENTOR(S) : YURI A. DREIZIN

It is certified that error appears in the above-identified patent and that said Letters Patent is hereby corrected as shown below:

Col. 6, line 7, delete "rail", insert --rails--

Col. 6, line 30, after "above", insert --discussed--

Col. 7, line 38, after "analysis", delete "as", insert --is--

Col. 7, line 47, delete " (ρr)", insert --($\rho_r$)--

Col. 7, line 50, delete "(δv)", insert --($\delta_v$)--

Col. 9, line 22, delete "$N_f$", insert --$n_f$--

Col. 9, line 23, after "of the", insert --foil--

Col. 10, line 48, delete "claim 8" insert --claim 7--

UNITED STATES PATENT AND TRADEMARK OFFICE

CERTIFICATE OF CORRECTION

PATENT NO. : 5,297,468

DATED : March 29, 1994

INVENTOR(S) : YURI A. DREIZIN

It is certified that error appears in the above-indentified patent and that said Letters Patent is hereby corrected as shown below:

Col. 10, line 49, delete "cross-sectional", insert --cross-section--

Col. 12, line 22, after "layers," insert --said first layer--

Signed and Sealed this

Fourth Day of October, 1994

*Attest:*

*Attesting Officer*

BRUCE LEHMAN

*Commissioner of Patents and Trademarks*